United States Patent [19]

Bettigole

[11] Patent Number: 4,865,486

[45] Date of Patent: Sep. 12, 1989

[54] METHOD OF ASSEMBLING A STEEL GRID AND CONCRETE DECK

[76] Inventor: Neal H. Bettigole, 601 Bergen Mall, Paramus, N.J. 07652

[21] Appl. No.: 153,945

[22] Filed: Feb. 9, 1988

[51] Int. Cl.[4] ..... E01D 21/04

[52] U.S. Cl. ..... 404/75; 404/44; 404/45; 404/70; 404/134; 14/1; 14/73

[58] Field of Search ..... 14/1, 73; 404/44, 45, 404/70, 72, 73, 75, 134; 52/664, 667, 668; 264/31, 46.7; 249/2, 61, 83

[56] References Cited

U.S. PATENT DOCUMENTS

| | | | |
|---|---|---|---|
| 185,302 | 12/1876 | Davison | 404/18 |
| 1,033,106 | 7/1912 | Kahn | 52/88 |
| 1,300,439 | 4/1919 | Madison | 404/18 |
| 1,613,063 | 1/1927 | Stark | 404/70 |
| 1,936,536 | 11/1933 | Bates | 14/73 |
| 1,984,944 | 12/1934 | Piccirilli | 404/34 |
| 2,053,135 | 9/1936 | Dalton | 14/73 |
| 2,096,629 | 10/1937 | Farrar et al. | 52/334 |
| 2,128,753 | 8/1938 | Lienhard | 14/73 X |
| 2,162,742 | 6/1939 | Nagin | 14/73 |
| 2,184,146 | 12/1939 | Leguillon | 404/32 |
| 2,190,214 | 2/1940 | Nagin | 52/667 |
| 2,246,766 | 6/1941 | Tarof | 14/73 X |
| 2,307,869 | 1/1943 | Tench | 14/73 |
| 2,437,095 | 3/1948 | Kahr | 404/18 |
| 2,645,985 | 7/1953 | Beebe et al. | 14/73 |
| 2,834,267 | 5/1958 | Beebe | 52/668 X |
| 2,880,116 | 3/1959 | Alps et al. | 404/18 |
| 3,110,049 | 11/1963 | Nagin | 14/73 |
| 3,110,981 | 11/1963 | Larner | 52/408 |
| 3,260,023 | 7/1966 | Nagin | 52/181 |
| 3,305,991 | 2/1967 | Weisman | 264/46.7 X |
| 3,363,379 | 1/1968 | Curran | 52/334 |
| 3,385,181 | 5/1968 | Stoll | 404/70 |
| 3,545,348 | 12/1970 | Anderson | 404/30 |
| 3,645,510 | 2/1972 | Klugman | 52/667 |
| 3,855,747 | 12/1974 | Langan | 404/18 |
| 3,906,571 | 9/1975 | Zetlin | 14/17 |
| 4,102,102 | 7/1978 | Greulich | 14/73 |
| 4,112,640 | 9/1978 | Reifsnyder | 52/667 X |
| 4,145,153 | 3/1979 | Fasullo et al. | 404/73 |
| 4,151,025 | 4/1979 | Jacobs | 14/73 |
| 4,168,924 | 9/1979 | Draper et al. | 404/70 |
| 4,201,023 | 5/1980 | Jungbluth | 52/334 |
| 4,244,768 | 1/1981 | Wiechowski et al. | 52/667 |
| 4,271,555 | 6/1981 | Mingolla et al. | 14/73 |
| 4,282,619 | 8/1981 | Rooney | 14/6 |
| 4,300,320 | 11/1981 | Rooney | 14/73 |
| 4,486,996 | 12/1984 | Alejos | 249/61 X |
| 4,531,857 | 7/1985 | Bettigole | 404/44 |
| 4,531,859 | 7/1985 | Bettigole | 404/73 |

*Primary Examiner*—Jerome W. Massie, IV
*Assistant Examiner*—Matthew Smith
*Attorney, Agent, or Firm*—Banner, Birch, McKie & Beckett

[57] ABSTRACT

The present invention is directed to a weldless pavement module and a method for making a weldless pavement module. Each of the primary load bearing bars is formed with openings for receiving slotted secondary load bearing bars which are passed through the primary load bearing bars in a substantially horizontal position and which are rotated into a vertical position. The size and shape of the openings and the slots permit the combination of primary load bearing bars and secondary load bearing bars to be skewed to form a nonrectangular parallelogram configuration. Simple tack welds are used to temporarily hold the grating in its desired configuration. A concrete component encases at least the top surface of the grating base member and permanently secures the elements of the grating base member together. The use of tack welds eliminates the requirement that the grating base member be bent into a convex shape prior to welding. A simple flat jig is used.

13 Claims, 3 Drawing Sheets

METHOD OF ASSEMBLING A STEEL GRID AND CONCRETE DECK

TECHNICAL FIELD

The present invention relates to an improved exodermic pavement module and a method for making the pavement module. More particularly, the present invention relates to an exodermic pavement module which may be constructed without structural welds. The invention also provides an exodermic pavement module which may readily be constructed in various configurations, including a conventional rectangle or a nonrectangular parallelogram.

BACKGROUND OF THE INVENTION

U.S. Pat. Nos. 4,531,857 and 4,531,859 disclose a revolutionary new design for roadway decks. These patents disclose a prefabricated pavement module for bridges and the like and a method for making the module. These deck modules are generally known in the industry as exodermic decks. Exodermic decks may be used to replace worn out or damaged conventional decks as well as to construct new roadways.

The exodermic deck is a design concept that combines a steel grid and reinforced concrete in a unique way. It maximizes the use of the compressive strength of concrete and the tensile strength of steel. Based on working stress principles, the design positions stress raisers in the steel grid at or close to the neutral axis of the composite deck.

The known exodermic deck includes a reinforced concrete component on top of, and bonded to, a welded steel grid or grating component typically including primary load bearing bars, secondary load bearing bars, and tertiary load bearing bars. The dimensions and properties of each component of the deck are selected for the specific bridge by the design engineer. The design is composite within itself and can be made composite with most types of existing or new bridge framing systems. In a typical practical application, the concrete component embeds a two-way web of epoxy-coated reinforcing bars. Vertical studs welded to the tertiary load bearing bars of the steel grid are also embedded in the concrete component of the deck. Horizontal shear transfer is developed through partial embedding of the tertiary load bearing bars in conjunction with the vertical studs.

An exodermic deck has section properties increased by 150% to 300% over that of known conventional grid deck constructions. High load capacity and extended useful life are provided by relocating the neutral axis of the composite deck, which reduces the maximum stress level in the top surface of the grid to a point at which fatigue failure should not occur. The exodermic deck system also eliminates the need for constant repair of broken grid bars and connections which is common in open grid deck installations. Moreover, an exodermic deck eliminates skidding and noise problems commonly associated with open grid deck bridges and with filled grid deck bridges which do not have a wearing surface above the grid. The exodermic deck also is significantly lighter than known filled or partially filled grid decks. This is highly desirable in bridge construction.

However, both with conventional open grid decks and filled grid decks, and with exodermic grid decks, known methods of making the heavy steel grids conventionally used structural welds to hold the primary, secondary, and tertiary load bearing bars together. The structural welding processes require the use of complex, fixed jigs to hold the load bearing bars in proper position. The jigs must clamp the bearing bars in a complex convex configuration so that after welding, when the welds and bars cool and contract, the resulting grid will be flat.

Another disadvantage of known construction methods for grid decks is that only rectangular grid modules have been formed. However, most bridges are skewed, having a nonrectangular parallelogram shape rather than a rectangular shape. Thus, it is highly desirable to produce bridge deck modules in the shape of nonrectangular parallelograms to match the bridge skew. In order to match the skewed bridge structures, present methods require the formation of a rectangular grid along with the formation of separate triangular grid pieces which are welded to the ends of the rectangular grid. This is a costly and complicated process.

SUMMARY OF THE INVENTION

It is an object of the present invention to provide an improved exodermic pavement module and method for making the pavement module wherein construction is simplified and costs are reduced.

It is another object of the present invention to provide a method and exodermic pavement module which can be formed having the configuration of a skewed, nonrectangular parallelogram.

These and other objects are accomplished by the present invention wherein a plurality of parallel primary or main load bearing bars intersect and interlock with a plurality of parallel secondary load bearing or distribution bars. Each of the primary load bearing bars has a plurality of openings corresponding to each of the secondary load bearing bars. Each of the secondary load bearing bars has a plurality of slots corresponding to each of the primary load bearing bars. The secondary load bearing bars are inserted in a horizontal position through the openings in the primary load bearing bars. The secondary load bearing bars are then rotated 90° into a vertical position so that the walls of each slot of the secondary load bearing bars fit over the web and flange of the primary load bearing bars. After this is accomplished, the primary and secondary load bearing bars are tack welded together. Where tertiary load bearing bars are used these are disposed across the secondary load bearing bars in between the primary load bearing bars. The tertiary load bearing bars are also tack welded. The tack welds secure the grid or grating temporarily until the concrete component may be formed on the grid. The concrete component permanently secures the grid in position. Therefore, structural welds are not required, and the grid may be formed using a simple jig with a flat surface. As structural welds are not used, there is no excess heat from welding, and the grid need not be bent into a convex shape to compensate for contraction as the welds cool.

Furthermore, after the secondary load bearing bars are inserted into the primary load bearing bars and are rotated into their vertical position, the existing grid may be skewed or distorted into a nonrectangular parallelogram shape which conforms to the desired shape of the paved surface. After the desired skewed shape is obtained, the tack welds are formed and the tertiary bars and vertical studs are added.

Various additional advantages and features of novelty which characterize the invention are further pointed out in the claims that follow. However for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 1:
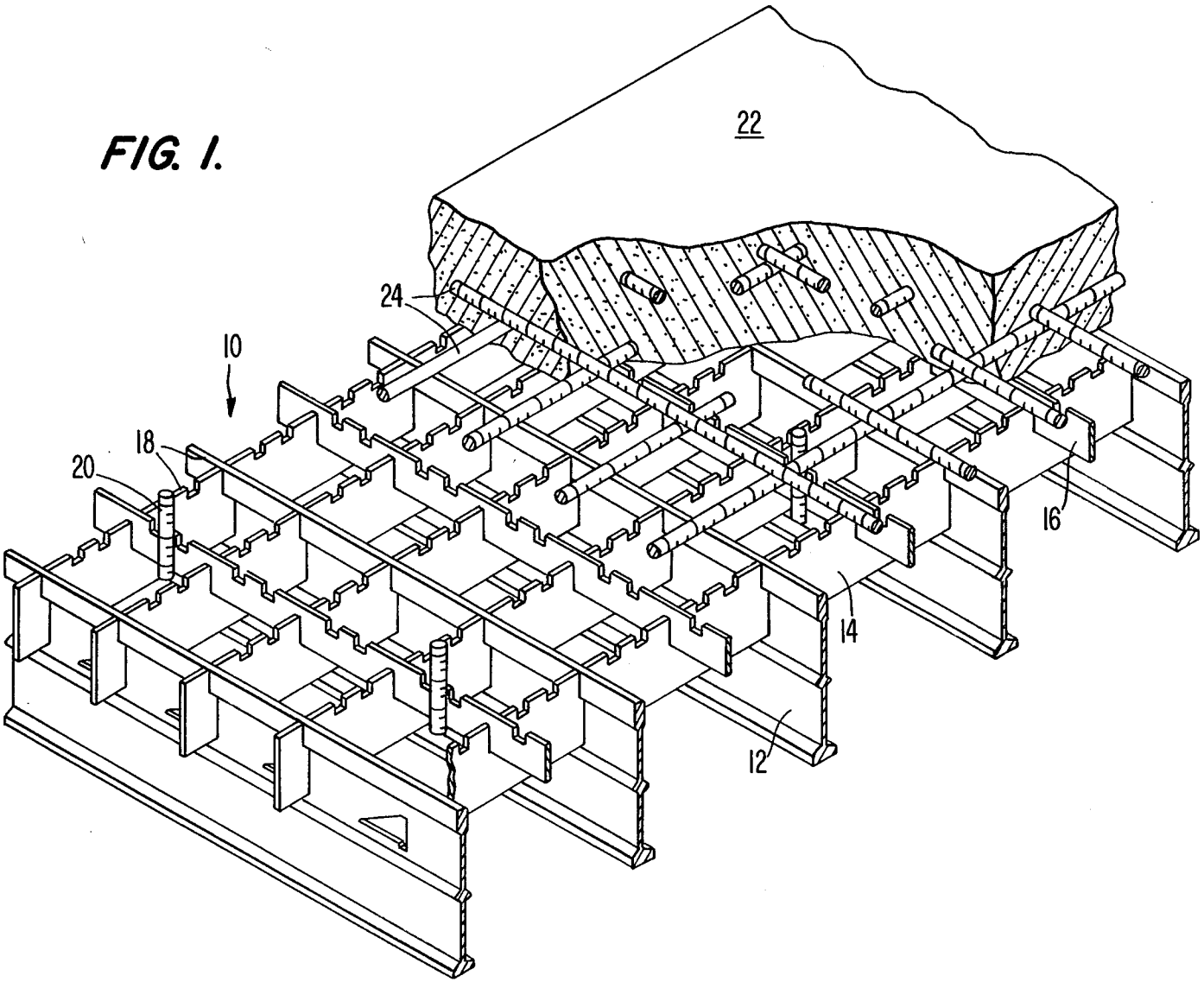
FIG. 1 is a perspective cutaway view of a bridge deck in accordance with the present invention.

FIG. 1 shows a portion of a grid deck according to the present invention. The grid deck includes grating base member 10 which is formed of primary load bearing bars 12, secondary load bearing bars 14, and tertiary load bearing bars 16. Grating base member 10 has a top surface 18. Concrete component 22 is disposed on top surface 18 of grating base member 10. Grating base member 10 may be made of metal, plastic, or any other suitable material, and may be galvanized, coated with an epoxy, or otherwise protected from deterioration.

As best shown in FIG. 1, primary load bearing bars 12 are disposed at spaced parallel locations from each other. Secondary load bearing bars 14 are disposed through primary load bearing bars 12. Tertiary load bearing bars 16 are disposed across secondary load bearing bars 14 between primary load bearing bars 12. Secondary load bearing bars 14 may be formed having tabs 26 at their top surface.

Primary load bearing bars 12 and secondary load bearing bars 14 are illustrated in detail in FIGS. 2–5. Primary load bearing bars 12 include a web 13, a flange 15, and assembly apertures 28 formed through through web 13. The number of apertures 28 in each primary load bearing bar 12 corresponds to the number of secondary load bearing bars 14 forming grating base member 10. As shown in the preferred form, assembly apertures 28 are substantially triangular to provide an aperture which permits intersection and interlocking of the primary and secondary load bearing bars, as described below, while retaining structural strength and integrity of web 13 of primary load bearing bars 12. Each assembly aperture 28 has base 30, altitude 32, and hypotenuse 34. Base 30 includes a groove or cutout portion 31, and each hypotenuse 34 includes flat portion 33. When secondary load bearing bars 14 are inserted through assembly apertures 28 and are rotated into the vertical position, flange 15 of each secondary load bearing bar 14 fits into and is retained in position by groove 31. Thus, there is no need to use a structural weld at this point to hold the primary load bearing bars 12 and secondary load bearing bars 14 in an assembled condition.

Figure 2:
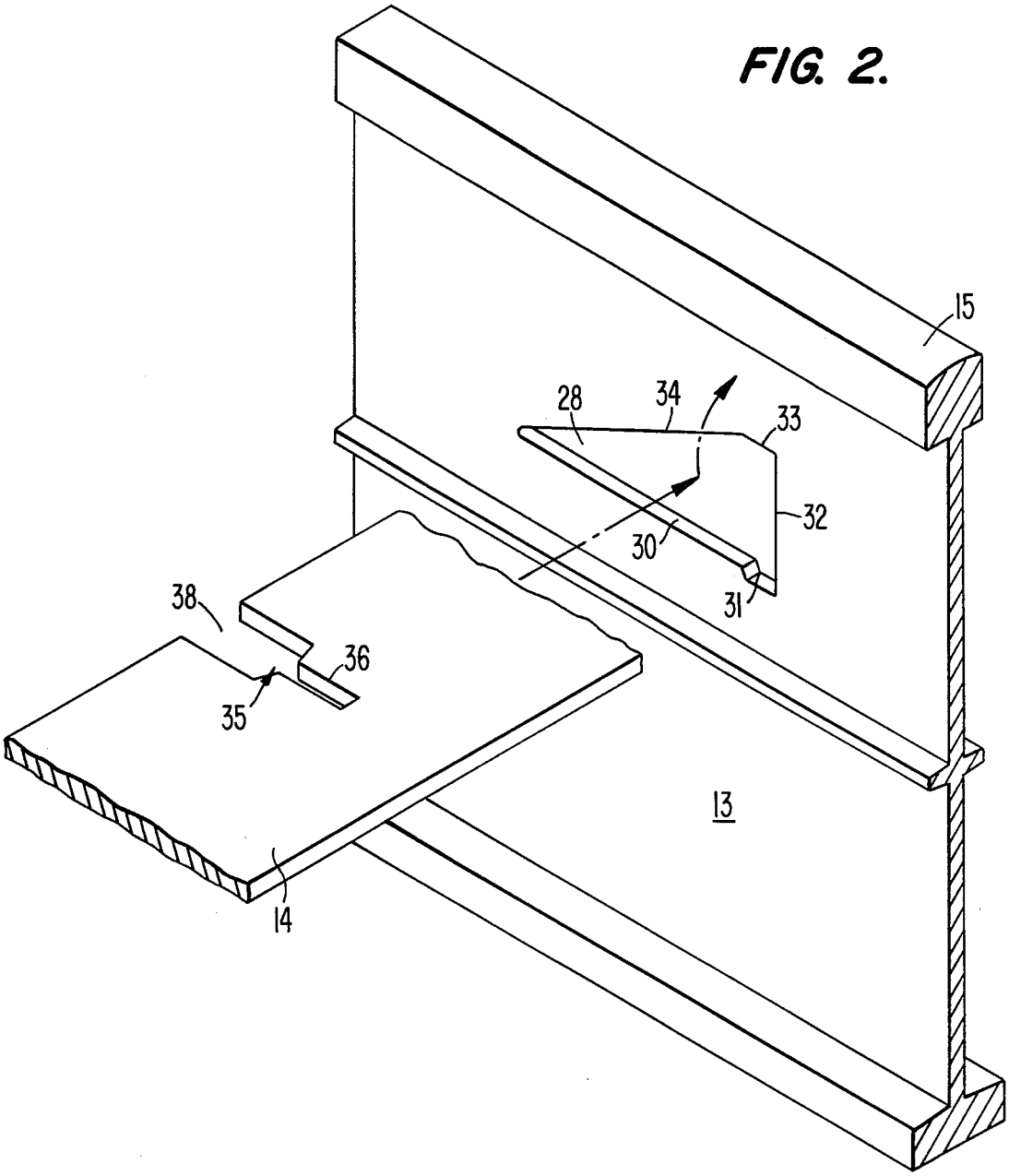
FIG. 2 is a perspective cutaway view of sections of a primary load bearing bar and a secondary load bearing bar prior to intersection of the two bars.
Figure 3:
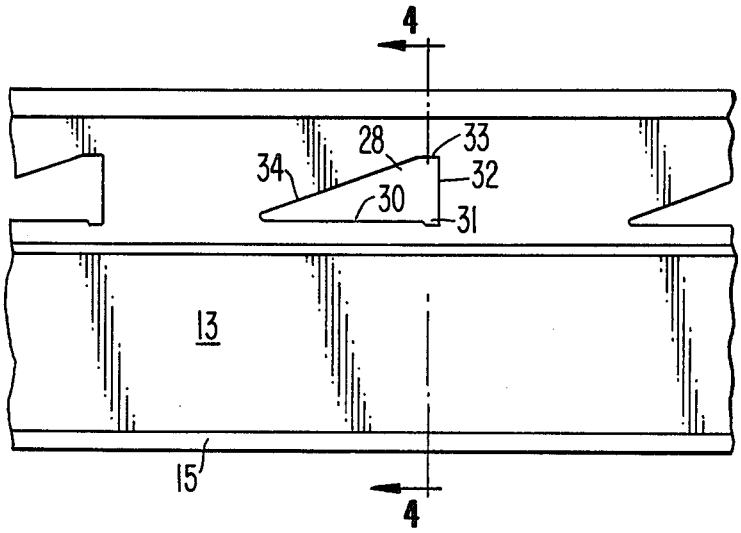
FIG. 3 is a sectional side view of a primary load bearing bar.
Figure 4:
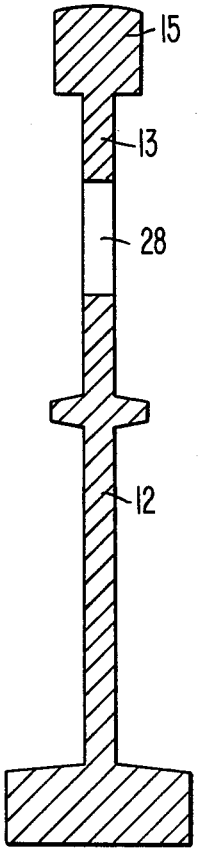
FIG. 4 is a sectional view of a primary load bearing bar taken along line 4—4 in FIG. 3.
Figure 5:
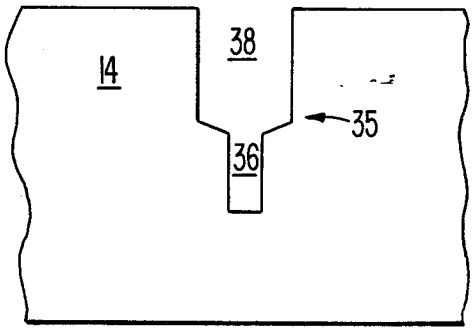
FIG. 5 is a partial side view of a secondary load bearing bar.

Each secondary load bearing bar 14 includes an assembly slot 35 having a first portion 36 which fits over web 13 when grating base member 10 is assembled, and a second portion 38 which fits over flange 15. The height of secondary load bearing bar 14 is slightly less than the length of base 30 of assembly aperture 28 so that secondary load bearing bar 14 can be inserted horizontally through primary load bearing bar 12, as shown in FIG. 2, and then rotated into a vertical position. The height minus the combined lengths of first portion 36 and second portion 38 of assembly slot 35 is slightly less than altitude 32 of triangular opening 28.

Shear members such as studs 20 are vertically mounted to tertiary load bearing bars 16. Studs 20 may be welded to tertiary load bearing bars 16. Alternatively, studs 20 may be otherwise fixed to tertiary load bearing bars 16, or may be integrally formed therewith. Studs 20 extend upwardly above top surface 18 of grating base member 10 and into concrete component 22 and permit concrete component 22 and grating base member 10 to function in a complementary fashion.

Reinforcing bars 24 or reinforcing mesh are placed on top of tertiary load bearing bars 16 of grating base member 10. Typically, reinforcing bars 24 are epoxy coated. Reinforcing bars 24 are encased within and strengthen concrete component 22 and contribute to the strength of grating base member 10 through composite action.

In constructing the pavement module, primary load bearing bars 12 are disposed in a simple jig which holds the bars in a spaced parallel relationship. Because structural welds and high heat are not used, the bars are not subject to contraction upon cooling. Therefore, the jig need not compensate for contraction of the bars. Accordingly, the bars may be assembled in a simple flat configuration. Secondary load bearing bars 14 are disposed in a substantially horizontal position as shown in FIG. 2 and are inserted through assembly apertures 28 of primary load bearing bars 12. Assembly apertures 28 on primary load bearing bars 12 align with each other in the jig, and one secondary load bearing bar 14 is inserted through each aligned series of assembly apertures 28 so that each secondary load bearing bar 14 passes through each primary load bearing bar 12. After secondary load bearing bars 14 are inserted through assembly apertures 28, each secondary load bearing bar 14 is rotated clockwise around its right end as shown in FIG. 2. The bottom edge of secondary load bearing bar 14 fits within cutout portion 31 of base 30 which facilitates rotation of secondary load bearing bars 14. After secondary load bearing bars 14 have been rotated 90°, they are disposed in their vertical location. Second portion 38 fits over flange 15 of primary load bearing bar 12; first portion 36 fits over web 13. After secondary load bearing bars 14 are properly positioned within primary load bearing bars 12, tertiary load bearing bars 16 are disposed across secondary load bearing bars 14.

Assembly aperture 28 need not be triangular as shown in the drawings. The opening may assume any convenient shape that permits the rotation of secondary load bearing bars 14 within primary load bearing bars 12 and has a vertical dimension sufficient to receive secondary load bearing bars 14. The structural integrity of primary load bearing bar 12 must, of course, be maintained.

Tack welds are used to temporarily hold secondary load bearing bars 14 to primary load bearing bars 12 and tertiary load bearing bars 16 to secondary load bearing bars 14 in their preferred orientation during further manufacture of the grid.

Figure 6:
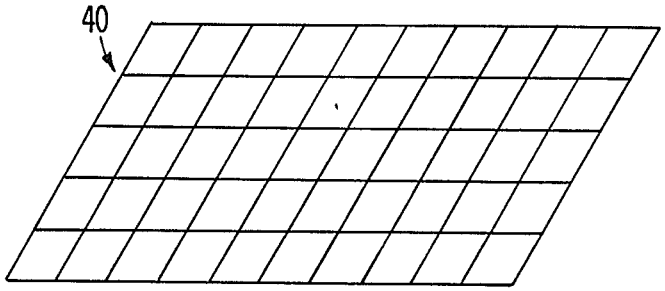
FIG. 6 is a schematic diagram of a pavement module in a skewed configuration.

As indicated above, one advantage of the present invention is that the pavement module may be formed in a skewed, nonrectangular parallelogram configuration 40 as shown in FIG. 6. Secondary load bearing bars 14 and primary load bearing bars 12 may be skewed into the desired configuration prior to tack welding. The unsecured condition of primary load bearing bars 12 and secondary load bearing bars 14 and the interlocking connection between the assembly apertures 28 of primary load bearing bar 12 and the assembly slots 35 of secondary load bearing bar 14 permit this skewing.

After the grid is in its preferred orientation, and studs 20 and reinforcing bars 24 are in their proper positions, a form board (not shown) is placed under grating base member 10 to form a lower barrier and prevent the passage of material through the interstices of grating base member 10. Sand, plastic foam, or other similar material is then applied to grating base member 10 to fill the interstices to a level substantially coplanar with top surface 18 of grating base member 10. The form board prevents the sand or other material from falling through grating base member 10.

Concrete component 22 is applied to top surface 18 of grating base member 10 to envelope reinforcing bars 24. Studs 20 are also enveloped by concrete component 22 but do not protrude therethrough. The sand or other material filling the interstices prevents concrete component 22 from filling the interstices so that the bottom surface of concrete component 22 is substantially coplanar with top surface 18 of grating base member 10. That is, the concrete component does not embed more than approximately $\frac{1}{8}$ inch of the top of the primary and secondary load bearing bars. As shown in FIG. 1, the top surface of secondary load bearing bars 14 may be somewhat irregular, such as by having upwardly projecting tabs 26 which are embedded in concrete component 22.

After concrete component 22 has cured, the form board and sand or other material filling the interstices are removed. Studs 20 and the upper portion of tertiary bars 16 are firmly fixed within concrete component 22. They create a composite interaction between concrete component 22 and grating base member 10 and serve to transfer horizontal shear between grating base member 10 and concrete component 22. Studs 20 also serve to prevent vertical separation of concrete component 22 and grating base member 10.

An asphaltic concrete or similar material wear surface (not shown) may be applied on top of concrete component 22 if desired.

In a preferred embodiment, the concrete component material is a high density low slump concrete, although other concrete formulations suitable as a wear surface may be used. High density concrete is preferable because it serves as an additional barrier to prevent moisture from reaching grating base member 10 and causing premature deterioration. A typical high density concrete would include approximately 31% each of coarse and fine aggregate; 6% air; 16% water; and 16% cement. A typical low slump is approximately $\frac{3}{4}$ inch. A latex modified concrete, as is well known in the art, could also be used as the top layer.

Exodermic deck pavement modules are commonly used to form composite concrete unfilled grid type modules for bridge flooring. These modules are manufactured according to uniformly acceptable standards and specifications. In a typical design, the concrete component is a reinforced concrete slab at least $2\frac{3}{4}$ inches thick, reinforced with No. 3 bars. The concrete slab does not embed more than $\frac{1}{8}$ inch of the top of the primary and secondary load bearing bars. That is, although the bottom surface of the concrete component is substantially coplanar with the top surface of the grating base member, up to approximately $\frac{1}{8}$ inch of the grating base member is embedded within the concrete component. The studs are spaced with at least one per square foot and are fillet welded to the tertiary load bearing bars approximately midway between the secondary load bearing bars. The studs preferably are No. 4 bars and extend from the bottom of the tertiary load bearing bars to one inch below the top surface of the concrete component. After placement of the deck modules, headed studs are attached to the structural framing supporting the exodermic deck and are spaced to assure full horizontal shear transfer between the bridge deck, including any additional wear surface, and the structural framing after the concrete is poured and cured.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

I claim:

1. A method of making a pavement module having an open lattice grating base member, said grating base member comprising a plurality of parallel primary load bearing bars intersecting and interlocking with a plurality of parallel secondary load bearing bars, each said primary load bearing bar having a plurality of assembly apertures corresponding in number to said secondary load bearing bars and each said secondary load bearing bar having a plurality of assembly slots corresponding in number to said primary load bearing bars, the method comprising the steps of:

(a) placing said plurality of parallel primary load bearing bars at spaced intervals;

(b) inserting said secondary load bearing bars in a substantially horizontal position through said assembly apertures until each said assembly slot lines up with a corresponding said assembly apertures;

(c) rotating said secondary load bearing bars 90° to a vertical position;

(d) tack welding said secondary load bearing bars to said primary load bearing bars; and (e) fixing a reinforced concrete component to said grating base member.

2. A method as set forth in claim 1 wherein each said assembly aperture has a cutout portion for receiving one end of said secondary load bearing bar and for facilitating rotation of said secondary load bearing bar into the vertical position, and wherein said assembly aperture has a horizontal wall surface opposite said cutout portion for facilitating the fit of said secondary load bearing bar within said assembly aperture.

3. A method as set forth in claim 2 further comprising the step of installing a plurality of tertiary load bearing bars between and parallel to said primary load bearing bars on the top surface of said grating.

4. A method as set forth in claim 3 further comprising the step of installing a plurality of shear connectors on said top surface of said grating base member so that said shear connectors are encased in said concrete component.

5. A method as set forth in claim 4 further comprising the step of curing said concrete component to thereby provide a composite interaction between said concrete component and said grating base member so that said shear connectors within said concrete component effect horizontal shear transfer and prevent vertical separation between said concrete component and said grating base member.

6. A method as set forth in claim 1 further comprising the step of placing reinforcing material on said top surface of said grating base member and encasing said reinforcing material in said concrete component.

7. A method as set forth in claim 1 further comprising the step of skewing said primary load bearing bars and said secondary load bearing bars to form a nonrectangular parallelogram.

8. A method as set forth in claim 1 wherein said skewing step is performed before said rotating step.

9. A method as set forth in claim 1 further comprising the step of disposing said primary and secondary load bearing bars in a jig which aligns said primary and secondary load bearing bars in a flat configuration before said tack welding step.

10. A method as set forth in claims 3, 4, or 5 further comprising the step of disposing said primary and secondary load bearing bars in a jig which aligns said primary and secondary load bearing bars in a flat configuration before said tack welding step.

11. A method of making a pavement module having an open lattice grating base member, said grating base member comprising a plurality of parallel primary load bearing bars intersecting and interlocking with a plurality of parallel secondary load bearing bars, each said primary load bearing bar having a plurality of assembly apertures corresponding in number to said secondary load bearing bars and each said secondary load bearing bar having a plurality of assembly slots corresponding in number to said primary load bearing bars, wherein each said assembly aperture has a cutout portion for receiving one end of said secondary load bearing bar and for facilitating rotation of said secondary load bearing bar into the vertical position, and wherein said assembly aperture has a horizontal wall surface opposite said cutout portion for facilitating the fit of said secondary load bearing bar within said assembly aperture, the method comprising the steps of:

(a) placing said plurality of parallel primary load bearing bars at spaced intervals;

(b) inserting said secondary load bearing bars in a substantially horizontal position through said assembly apertures until each said assembly slot lines up with a corresponding assembly aperture, said primary and secondary load bearing bars being aligned in a flat configuration;

(c) rotating said secondary load bearing bars 90° to a vertical position;

(d) installing a plurality of tertiary load bearing bars between and parallel to said primary load bearing bars on said top surface of said grating;

(e) tack welding said secondary load bearing bars to said primary load bearing bars and tack welding said tertiary load bearing bars to said secondary load bearing bars;

(f) installing a plurality of shear connectors on said top surface of said grating base member;

(g) placing reinforcing material on said top surface of said grating base member;

(h) providing a concrete component fixed to the top surface of said grating base member encasing said shear connectors and said reinforcing material, wherein the bottom surface of said concrete component is substantially coplanar with the top surface of said grating base member; and (i) curing said concrete component to thereby provide a composite interaction between said concrete component and said grating base member so that said shear connectors within said concrete component effect horizontal shear transfer and prevent vertical separation between said concrete component and said grating base member.

12. A method as set forth in claim 11 further comprising the step of skewing said primary load bearing bars and said secondary load bearing bars to form a nonrectangular parallelogram.

13. A method as set forth in claim 1 wherein said step of fixing said concrete component to said grating base member further comprises fixing said concrete component to said top surface of said grating base member so that the bottom surface of said concrete component is substantially coplanar with the top surface of said grating base member.

* * * * *